US012049817B2

(12) United States Patent
Radtke et al.

(10) Patent No.: US 12,049,817 B2
(45) Date of Patent: Jul. 30, 2024

(54) DOWNHOLE ROBOTIC ARM

(71) Applicant: BAKER HUGHES, Houston, TX (US)

(72) Inventors: Daniel Radtke, Katlenburg-Lindau (DE); Thomas D. Herrmann, Celle (DE)

( * ) Notice: Subject to any disclaimer, the term of this patent is extended or adjusted under 35 U.S.C. 154(b) by 0 days.

(21) Appl. No.: 17/683,255

(22) Filed: Feb. 28, 2022

(65) Prior Publication Data

US 2022/0333484 A1 Oct. 20, 2022

Related U.S. Application Data

(63) Continuation of application No. 17/010,571, filed on Sep. 2, 2020, now abandoned, which is a continuation of application No. 15/244,679, filed on Aug. 23, 2016, now abandoned.

(51) Int. Cl.

| | |
|---|---|
| ***E21B 49/00*** | (2006.01) |
| ***E21B 10/02*** | (2006.01) |
| ***E21B 47/007*** | (2012.01) |
| ***E21B 47/024*** | (2006.01) |
| ***E21B 47/06*** | (2012.01) |
| ***E21B 47/07*** | (2012.01) |
| ***E21B 47/135*** | (2012.01) |
| ***E21B 47/18*** | (2012.01) |
| ***E21B 49/06*** | (2006.01) |
| ***E21B 49/10*** | (2006.01) |

(52) U.S. Cl.

CPC ..... *E21B 49/00* (2013.01); *E21B 10/02* (2013.01); *E21B 47/007* (2020.05); *E21B 47/024* (2013.01); *E21B 47/06* (2013.01); *E21B 47/07* (2020.05); *E21B 47/135* (2020.05); *E21B 47/18* (2013.01); *E21B 49/06* (2013.01); *E21B 49/10* (2013.01)

(58) Field of Classification Search

CPC ..... E21B 49/00; E21B 49/06; E21B 49/10; E21B 47/06; E21B 47/024; E21B 47/07; E21B 47/007; E21B 47/135; E21B 47/18; E21B 10/02

See application file for complete search history.

(56) References Cited

U.S. PATENT DOCUMENTS

| | | | | |
|---|---|---|---|---|
| 4,354,558 | A * | 10/1982 | Jageler | E21B 49/06 175/45 |
| 5,617,927 | A | 4/1997 | Maissa | |
| 8,210,284 | B2 | 7/2012 | Buchanan et al. | |
| 8,919,460 | B2 | 12/2014 | Joulin et al. | |

(Continued)

OTHER PUBLICATIONS

PCT Application No. PCT/US2017/048231—Int'l Preliminary Report on Patentability, dated Mar. 7, 2019 (Mar. 7, 2019).

(Continued)

*Primary Examiner* — Christopher J Sebesta

(74) *Attorney, Agent, or Firm* — Crowe & Dunlevy, P.C.

(57) ABSTRACT

An apparatus for manipulating an object in a borehole in an earthen formation includes a body configured to be conveyed along the borehole and a plurality of linear actuators disposed in the body and operatively connected to the object. The plurality of linear actuators applies a translational and rotational movement to the object. A related method includes applying a translational and rotational movement to the object using the plurality of linear actuators.

22 Claims, 5 Drawing Sheets

(56) References Cited

U.S. PATENT DOCUMENTS

| | | | | |
|---|---|---|---|---|
| 2004/0140126 | A1* | 7/2004 | Hill | E21B 49/06 175/58 |
| 2005/0067166 | A1 | 3/2005 | Trueman et al. | |
| 2007/0045005 | A1* | 3/2007 | Tchakarov | E21B 49/06 175/58 |
| 2010/0282516 | A1 | 11/2010 | Buchanan et al. | |
| 2011/0094801 | A1* | 4/2011 | Buchanan | E21B 4/04 175/249 |
| 2011/0147086 | A1 | 6/2011 | Hummes et al. | |
| 2012/0180593 | A1 | 7/2012 | Alet et al. | |
| 2013/0068531 | A1* | 3/2013 | Joulin | E21B 4/02 175/78 |
| 2014/0131033 | A1 | 5/2014 | Galvan-Sanchez et al. | |

OTHER PUBLICATIONS

PCT Application No. PCT/US2017/048231—PCT Search Report dated Nov. 29, 2017 (Nov. 29, 2017).

* cited by examiner

DOWNHOLE ROBOTIC ARM

CROSS-REFERENCE TO RELATED APPLICATIONS

This application is a continuation of U.S. patent application Ser. No. 17/010,571, filed Sep. 2, 2020, which is a continuation of U.S. patent application Ser. No. 15/244,679, filed Aug. 23, 2016, the disclosure of which is incorporated herein by reference in its entirety.

BACKGROUND OF THE DISCLOSURE

1. Field of the Disclosure

This disclosure relates generally to actuators for downhole tools.

2. Description of the Related Art

Oil and gas wells have been drilled at depths ranging from a few thousand feet to as deep as five miles. A large portion of the current drilling activity involves directional drilling that includes drilling boreholes deviated from vertical by a few degrees to horizontal boreholes, to increase the hydrocarbon production from earth formations. Conventional drilling assemblies can include a suite of tools and instruments to effectuate drilling and obtain information relating to the formation being drilled. Some of these tools and instruments may require manipulation while downhole. For instance, information about the subterranean formations traversed by the borehole may be obtained using sidewall coring tools. Such tools use coring bits that are extended laterally from the drilling assembly and pressed against a borehole wall. Once a coring sample is obtained, the coring bit is retracted into the drilling assembly.

In certain aspects, the present disclosure addresses the need to efficiently manipulate sidewall coring bits. More generally, the present disclosure addresses the need to manipulate physical objects when confined to very restricted boundaries.

SUMMARY OF THE DISCLOSURE

In aspects, the present disclosure provides an apparatus for manipulating an object in a borehole in an earthen formation. The apparatus may include a body configured to be conveyed along the borehole and a plurality of linear actuators disposed in the body and operatively connected to the object. The plurality of linear actuators applies a translational and rotational movement to the object.

In aspects, the present disclosure provides a method for manipulating an object in a borehole in an earthen formation. The method may include disposing a plurality of linear actuators in a body; operatively connecting the object to the plurality of linear actuators; conveying the body into the borehole; and applying a translational and rotational movement to the object using the plurality of linear actuators.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1:
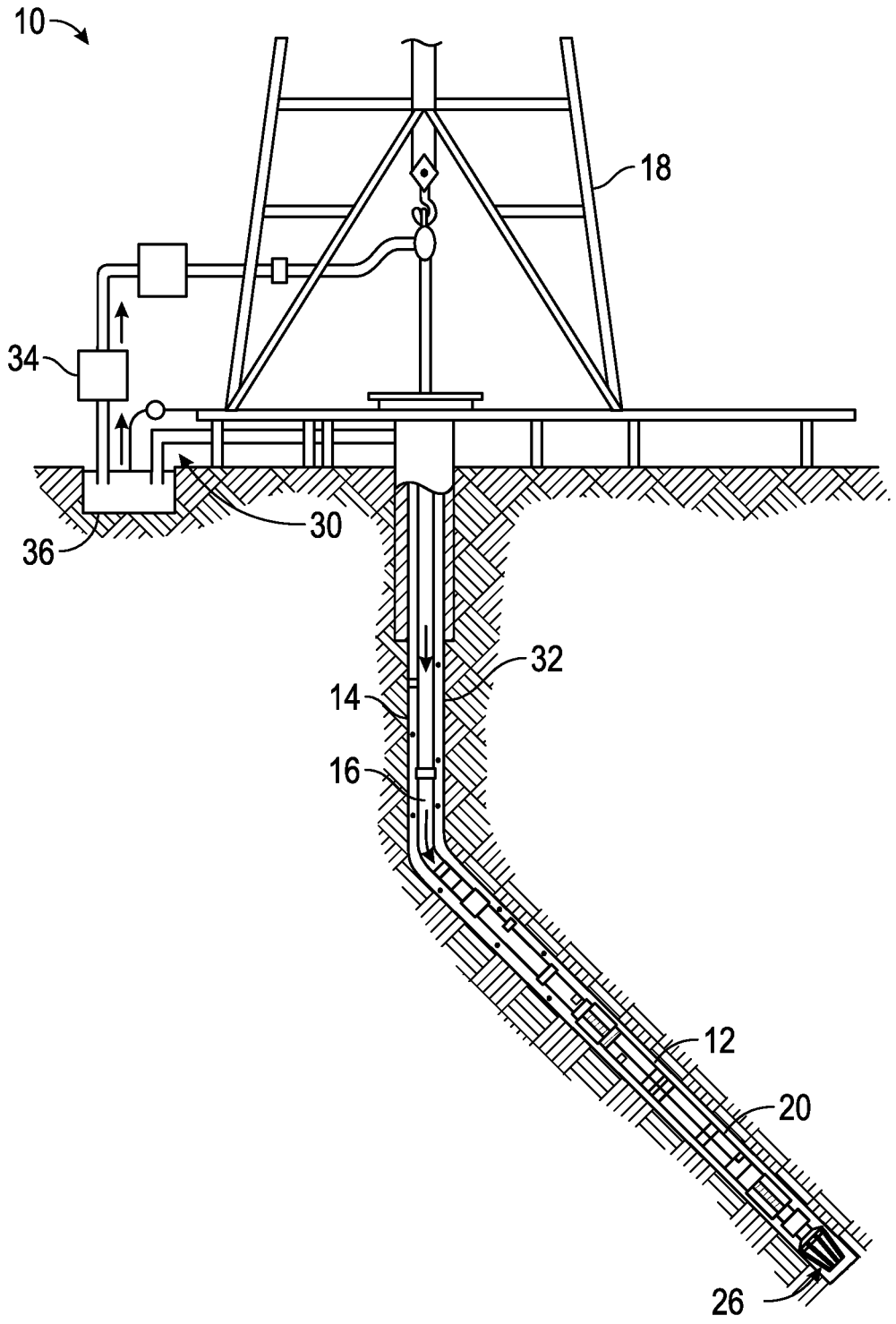
FIG. 1 illustrates a drilling system that incorporates one or more actuator assemblies made in accordance with embodiments of the present disclosure.

The present disclosure relates to actuator assemblies that may be used to manipulate objects in locations where space is limited. The downhole environment is one example of a situation wherein the motion of physical objects must be confined to very restricted boundaries. As will be appreciated from the discussion below, actuator assemblies according to the present disclosure are well suited to manipulating objects in environments that have limited room. These actuator assemblies may be compact yet possess a very high degree of articulated movement in multiple directions, and therefore can be used in areas having small volumes. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

While the present disclosure is described in the context of a hydrocarbon producing well, the present teachings may be equally applied to a water well, a geothermal well, or any other human made feature for accessing the subsurface. Likewise, the present teachings are not limited to only drilling systems that are discussed below. For instance, the actuator assemblies of the present disclosure may also be used in connection with well tools that are conveyed by non-rigid carriers such as wireline, slickline, or e-lines.

Referring now to FIG. 1, there is shown an embodiment of a drilling system 10 that may use actuator assemblies according to the present disclosure. While a land-based rig is shown, these concepts and the methods are equally applicable to offshore drilling systems. The system 10 shown in FIG. 1 has a bottomhole assembly (BHA) 20 conveyed in a borehole 14 via a drill string 16. The drill string 16, which include drill pipe or coiled tubing, extending downward from a rig 18 into the borehole 14. The drill string 16 may provide bi-directional communication using wired pipe, mud pulse telemetry, fiber optic lines, EM signals, or other suitable systems that enable downlinks and/or uplinks. The drill string 16 may be rotated by a top drive (not shown) or other suitable rotary power device. The BHA 20 may include a drill bit 26. One or more mud pumps 34 at the surface draw the drilling fluid, or "drilling mud," from a mud pit 36 and pump the drilling mud via the drill string 16 into the borehole 14. The drilling mud exits at the drill bit 26 and flows up the annulus to the surface.

Depending on the application, the BHA 20 may also include other devices (not shown) such as a steering unit, a drilling motor, a sensor sub, a bidirectional communication and power module (BCPM), and a formation evaluation (FE) sub. In some configurations, the BHA 20 may include active stabilizers, under-reamers, tractors, thrusters, downhole blow-out preventers, etc. The BHA 20 may include numerous instruments and tools designed to perform any number of downhole tasks. While some of these devices may be static, other devices may move relative to the BHA 20 during operation.

Figure 2:
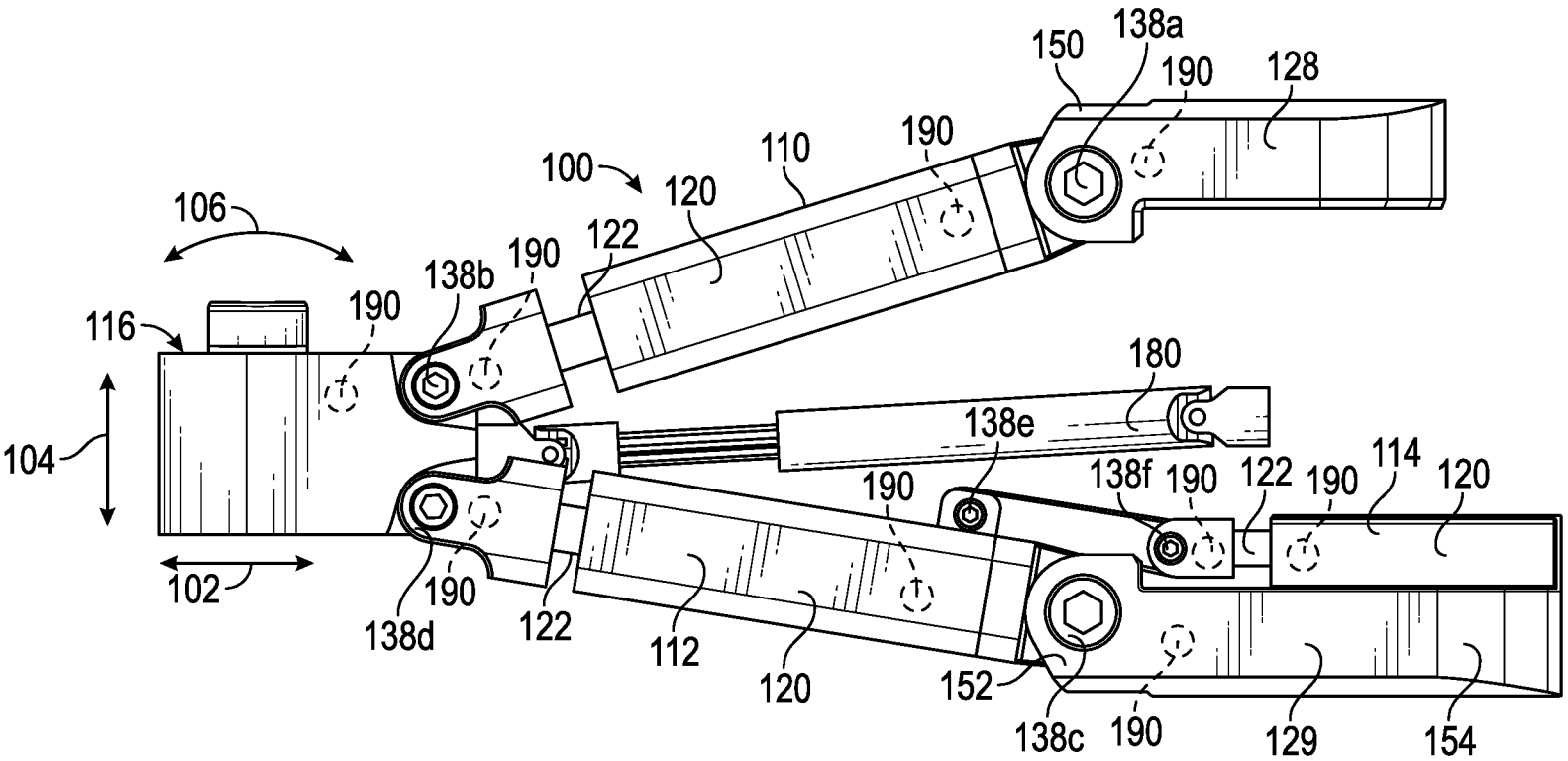
FIG. 2 illustrates an actuator assembly in accordance with embodiments of the present disclosure.

Referring to FIG. 2, there is shown one embodiment of an actuator assembly 100 according to the present disclosure that can be operatively connected to and thereby move an object, component, part, subassembly, or section of a BHA tool, or other downhole tool, in two or more directions. The actuator assembly 100 operates in two translational directions and one rotary direction. For example, a first translational direction 102 may be parallel with a longitudinal axis of the borehole 14 (FIG. 1), a second translational direction 104 may be transverse to the borehole longitudinal axis, and the rotary direction 106 may be a tilting or pivoting action. By operatively connected, it is meant that the connection between the actuator assembly 100 and the object to be manipulated can transfer the driving forces generated by the actuator assembly 100 to the object.

In one arrangement, the actuator assembly 100 may use three actuators 110, 112, 114 to physically manipulate an object 116, which may be part of the object. The manipulation can include translation/axial displacement and tilting. That is, the actuator assembly 100 can apply a translational and rotational movement to the object 16. The term "rotational" encompasses tilting, pivoting, and other motions about one or more axes. The object 116 can be configured for a number of different functionalities that may require precise positioning and motion.

The actuators 110, 112, 114 may be linear actuators that provide the object 116 with multiple degrees of freedom of motion. In embodiments, each actuator 110, 112, 114 may include a power section 120 and an extension section 122. The power section 120 may be a cylinder or a motor and the extension section 122 may be a rod, shaft, or other elongated member. In a conventional manner, the power section 120 can axially extend and retract the extension section 122. The actuators 110, 112, 114 can be driven hydraulically by double acting pistons with servo-hydraulic drive units or single acting pistons with integrated spring retract, driven electrically via spindle drives, or driven with any other drive assembly that provides principally linear movement. Linear actuators principally generate a drive force that linearly displaces an object (e.g., "pull" or "push") as opposed to outputting a rotary force.

In one arrangement, the actuators 110, 112 directly manipulate the object 116 and the actuator 114 directly manipulates the actuator 112. This arrangement may be implemented by: connecting one end of the actuator 110 to a stationary structure 128 of the BHA 20 (FIG. 1) using a pin joint 138*a* at an anchor point 150 and connecting the other end of the actuator 110 with a pin joint 138*b* to the object 116; connecting one end of the actuator 112 to a stationary structure 129 of the BHA 20 (FIG. 1) using the pin joint 138*c* at an anchor point 152 and connecting the other end of the actuator 112 with a pin joint 138*d* to the object 116; and rigidly fixing one end of the actuator 114 to the stationary structure 129 at an anchor point 154 and connecting the other end of the actuator 114 to the actuator 112 with the pin joint 138*e*. Additionally, the extension section 122 of the actuator 114 is itself articulated and includes a pin joint 138*f*. The pin joints 138*a-f* are merely illustrative of joints configured to allow relative rotation between the connected components. This rotation may around multiple axes. That is, the joints are articulated to allow the connected members to pivot or tilt relative to one another. Hereafter, such joints will be referred as pivot joints.

The range of movement of the object 116 is only limited by the stroke of the actuators 110, 112, 114 and the attack angle. The attack angle is a function of the anchor points 150, 152, 154 at which the actuators 110, 112, 114 are fixed to the housing and the stroke built-in in each of the actuators 110, 112, 114. Thus, the attack angle changes as a function of the stroke of the actuators 110, 112, 114. The actuator 114 controls the attack angle of the actuator 112. By using the three actuators 110, 112, 114, the actuator assembly 100 is statically defined with three controllable degrees of freedom of movement. Specifically, the actuator assembly 100 can have linear movement along two axes under different angles as well as the movement along interpolated curves. Furthermore, the object 116 can be tilted to a limited angle independent from the other movements.

By way of non limiting example, the actuator assembly 100 has a relatively flat and compact configuration. This compact configuration is possible due to the actuators 110, 112, 114 being linearly aligned (side-by-side) and arranged along the same geometric plane. Because the actuators 110, 112, 114 are linear actuators, the translating motions of the actuators 110, 112, 114 are also along the same geometric plane.

Figure 3:
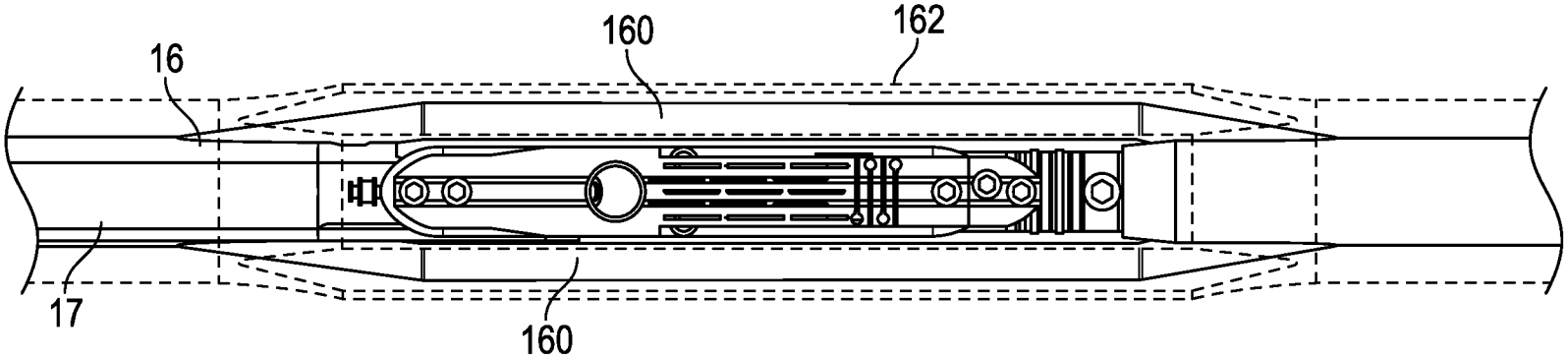
FIG. 3 illustrates a side view of a section of a drill string having an actuator assembly in accordance with embodiments of the present disclosure.
Figure 4:
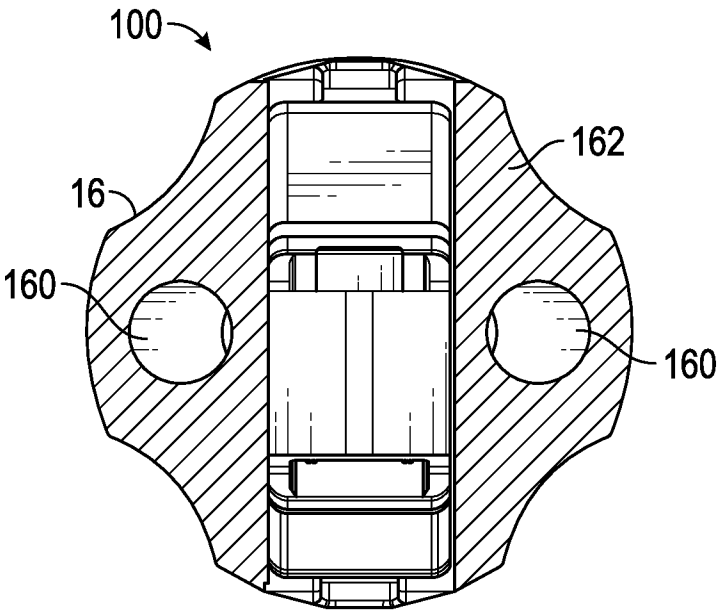
FIG. 4 sectionally illustrates the FIG. 3 embodiment.

FIG. 3 illustrates a side view of a section of the drill string 16 that includes the actuator assembly 100 (FIG. 2) and FIG. 4 illustrates a sectional view of that section of the drill string 16. As best shown in FIG. 4, the actuator assembly 100 may be positioned centrally in the drill string 16. In one arrangement, one or more fluid passages 160 may be formed next to the actuator assembly 100. While the FIGS. 3 and 4 embodiment shows two fluid passages 160, one fluid passage or three or more fluid passages may be used. Moreover, the fluid passages do not need to be symmetrically arranged. It should be appreciated that the above-described compact arrangement of the actuator assembly 100 allows the fluid passages 160 to be formed on the periphery of and run alongside the actuator assembly 100. These fluid passages 160 allow drilling fluid in the drill string 16 to flow past the actuator assembly 100; e.g., flow from the surface via a bore 17 of the drill string 16 to the drill bit 26 (FIG. 1). In one non-limiting arrangement, the fluid passages 160 may be bores formed in a body 162 of a section of the BHA 20 (FIG. 1). The body 162 may be a sub, housing, enclosure, tubular member, or other suitable structure along the BHA 20 (FIG. 1).

Figure 5:
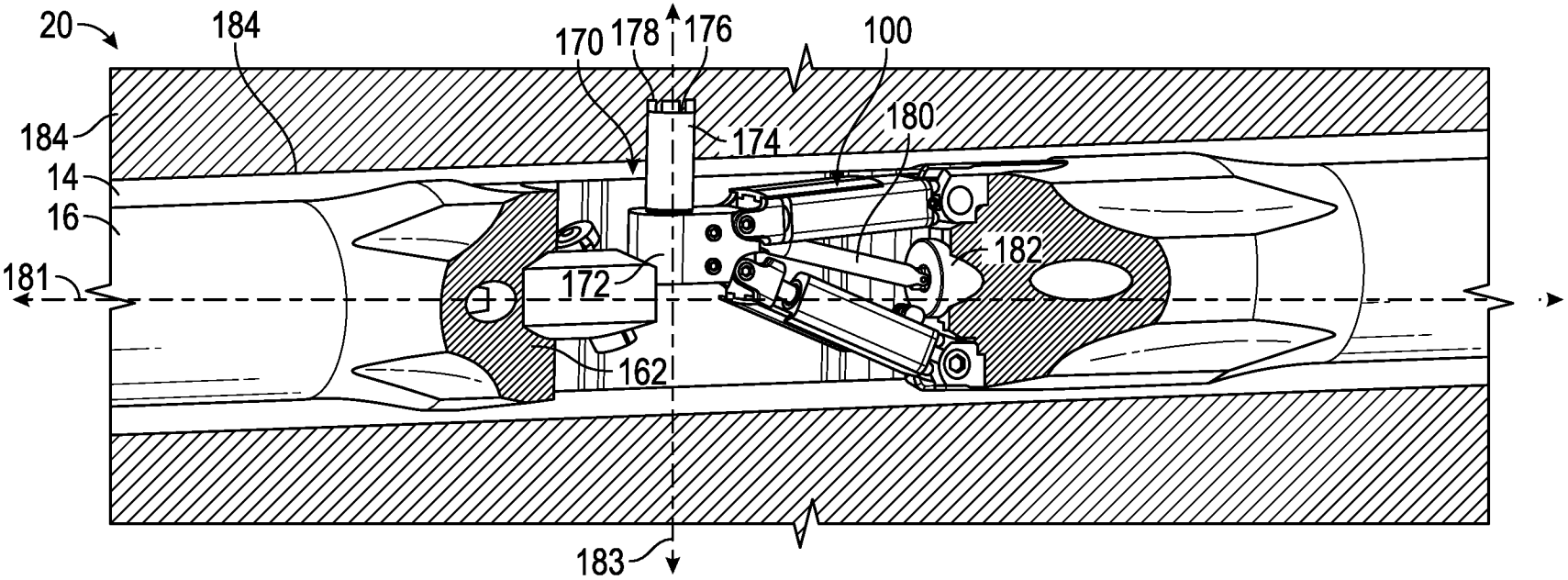
FIGS. 5 and 6 illustrate a sidewall coring bit being manipulated by an actuator assembly made in accordance with embodiments of the present disclosure.
Figure 6:
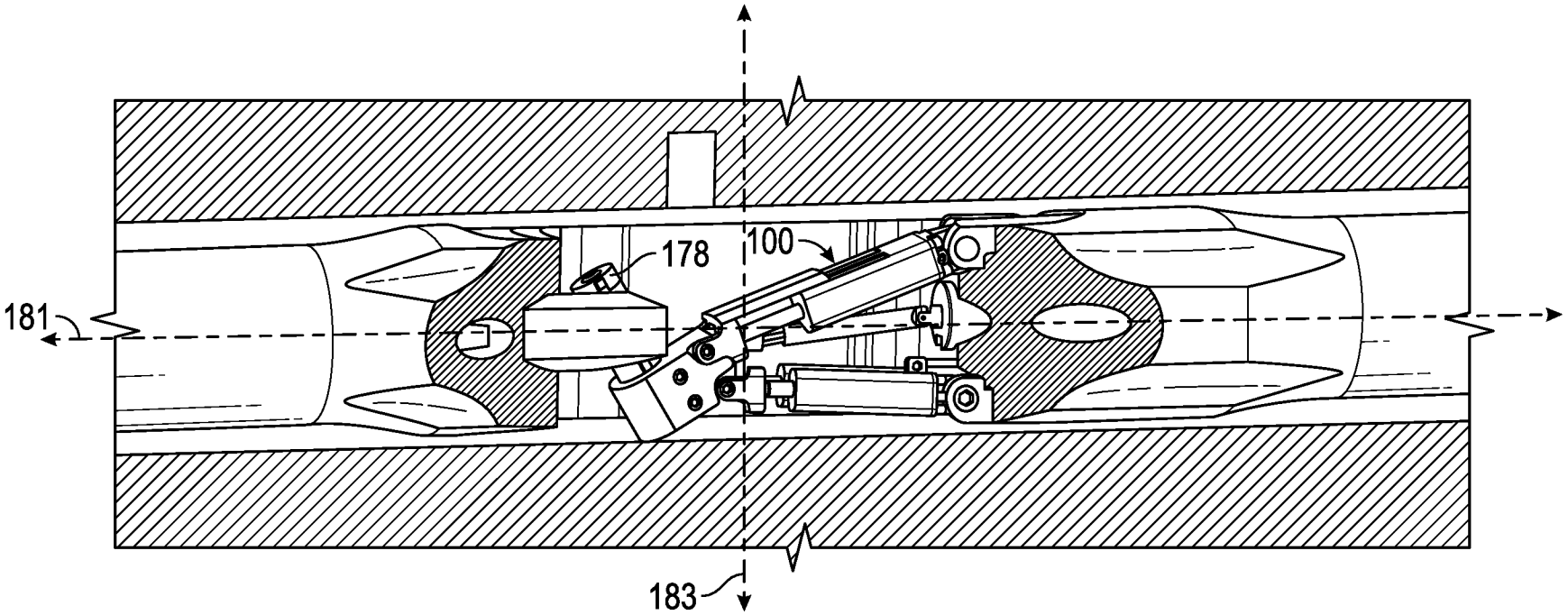

In some non-limiting embodiments, the actuator assembly 100 may be used in connection with formation sampling devices, as described below. FIGS. 5 and 6 illustrate a sidewall coring device 170 positioned along a drill string 16 and in a borehole 14. The sidewall coring device 170 may be disposed in a sub or other enclosure of a BHA 20. For purposes of the present disclosure, the longitudinal axis of the borehole 14, BHA 20, and the drill string 16 are considered as the same axis 181. A transverse axis 183, which can be considered a radial direction, is orthogonal to the longitudinal axis 181.

Referring to FIG. 5, there is shown an embodiment with an object comprising a device. By non-limiting example such a device may be a sidewall coring device 170. The sidewall coring device 170 may include a head unit 172 having a drilling shaft 174 with a device interface 176 for a coring bit 178. A motor, here referred to as power unit, is operatively connected to the coring bit. The power unit transmits a rotation to the coring bit. The connection to the coring bit may include a driveshaft 180 which transmits the rotation of an external power unit 182 to the coring bit 178. By non-limiting example the driveshaft may be a flexible or rigid driveshaft or a cardan shaft.

During operation, the actuator assembly 100 extends the coring bit 178 laterally out of the body 162 and into contacting engagement with a borehole wall 184. Thereafter, the coring bit 178 is rotated by the driveshaft 180 to cut a coring sample. Once the coring bit 178 has penetrated into the formation a desired depth, the actuator assembly 100 can shift or move the coring bit 178 as needed in order to snap or break off the coring sample from the formation. The actuator assembly 100 can then retract the coring bit 178 into the body 162. Referring to FIG. 6, after the coring bit 178 is fully retracted into the body 162 (FIG. 5), the actuator assembly 100 can orient and move the core or whole coring bit 178 into a suitable storage for core containers or a core magazine for retrieval to the surface.

In embodiments, the actuator assembly 100 can perform functions beyond simply manipulating the coring bit 178. For example, the linear actuators 116 may manipulate objects such as storages for core containers or core magazines, slide sleeves between positions, and other devices disposed along or drill string 16 or even external to the drill string 16.

From the above, it should be appreciated that the actuator assembly 100 can efficiently initiate a series of discrete movements while requiring only a relatively small amount of space in the BHA 20. As shown in FIG. 5, the actuator assembly 100 drives the coring bit 178 against the borehole wall 184. The actuators 110, 112, 114 each apply a force that collectively causes this lateral motion, which may also be considered a radially outward movement. To break off a coring sample, the object 116 may need to be tilted and/or axially shifted. The actuators 110,114 can provide the necessary force to effectuate such motions. As shown in FIG. 6, a tilting or rotation may be used to deposit or secure the coring sample in a suitable receptacle. The actuators 110, 112, 114 also cooperate to provide the necessary force to tilt and also axially shift the coring sample. Thus, the actuators 110, 112, 114 can be generate movements that are linear and rotational. Moreover, these movements can be along multiple axes. Also, the term rotational encompasses tilting and pivoting around multiple axes.

Referring to FIG. 2, in some embodiments, sensors 190 may be distributed throughout the actuator assembly 100 and the object to provide information and data for controlling the actuators 110, 112, 114 and data on the condition of the object. The information for controlling the actuators may relate to position, orientation, stroke, displacement, rotation or other physical or operating condition. The data on the condition of the object may relate to temperature, pressure, acceleration, RPM. Suitable sensor include, but are not limited to, linear displacement sensors (e.g., LVDT sensors), accelerometers, contact sensors, pressure sensors, temperature sensors, RPM sensors, pressure sensors, stress sensors, etc. In one non-limiting embodiment sensors 190 may be positioned inside and adjacent to the actuators 110, 112, 114 to measure the stroke of each actuator for motion control. Suitable electric and hydraulic connections may be provided between the actuators 110, 112, and the anchor blocks 128 and 129 via rotary feed-thrus. A suitable programmed controller (not shown) having circuitry, memory modules, and the necessary algorithms may automatically move the actuators 110, 112, 114.

The actuator assembly 100 may be operated autonomously or be partly or completely controlled from the surface. In some arrangements, information from the sensors 190 and other sensors may be sent via uplinks to the surface so that operators using suitable controllers and displays can monitor the activity, position, and condition of the actuator assembly 100. Based on this information, operators can send control signals via downlinks to operate the actuator assembly 100. The uplinks and downlinks can be transmitted via the communication devices previously discussed: mud pulse telemetry, wired pipe, optical fibers, EM signals.

From the above, it should be appreciated that the actuator assemblies of the present disclosure may be used to manipulate various downhole objects. For instance, the object of the actuator assembly can comprise fluid sampling devices, fluid sampling containers, borehole calipers, and other instruments. The linear actuators may also be used to extend or retract pads, move devices such as cutting elements (e.g., saws, fluid emitting nozzles, lasers, etc.), or screw drivers, anchors, sliding sleeves, etc., and grasping devices (e.g., magnets, tongs, hooks, etc). Thus, the object may interact with any downhole assembly, the borehole, wellbore tubulars (e.g., casing, liners, screens), wellbore fluids, and/or the formation.

The actuator assembly 100 may be energized using downhole and/or surface sources. Downhole sources include fuel cells, electrical batteries, electrical power generators and hydraulic sources, pneumatic sources. Surface sources include electrical power lines, pressurized fluid lines, etc.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

What is claimed is:

1. An apparatus for manipulating an object in a borehole in an earthen formation, comprising:

a body configured to be conveyed along the borehole; and a plurality of linear actuators disposed in the body and operatively connected to the object, the plurality of linear actuators applying at least one selected movement to the object, wherein the plurality of linear actuators includes at least a first linear actuator including an extension section and a power section, a second linear actuator including an extension section and a power section, and a third linear actuator including an extension section and a power section, wherein the first linear actuator and the second linear actuator are configured to manipulate the object, and wherein the third linear actuator is configured to manipulate the object by moving the first linear actuator wherein the extension section of the first linear actuator is connected to the object by a first pivot joint, the extension section of the second linear actuator is connected to the object by a second pivot joint, the power section of the first linear actuator is connected to the body by a third pivot joint, and the extension section of the third linear actuator is connected to the power section of the first linear actuator by a fourth pivot joint.

2. The apparatus of claim 1, wherein the power section of the third linear actuator is operatively connected to the body.

3. The apparatus of claim 1, further comprising at least one fluid channel through the body, the at least one fluid channel conveying a fluid during borehole operation.

4. The apparatus of claim 1, further comprising at least one sensor associated with at least one linear actuator of the plurality of linear actuators or the object, the at least one sensor measuring a movement of the at least one linear actuator of the plurality of linear actuators or measuring data on a condition of the object.

5. The apparatus of claim 1, wherein the object comprises one of: (i) a coring container, and (ii) a fluid sampling container.

6. The apparatus of claim 1, further comprising a driveshaft, wherein the driveshaft is selected from one of: (i) a flexible driveshaft, (ii) a rigid driveshaft, and (iii) a cardan shaft.

7. The apparatus of claim 1, further comprising a drill string on which the plurality of linear actuators are positioned; and the object comprising a coring bit, the coring bit being configured to extend laterally from the drill string and contact an adjacent borehole wall, and wherein the plurality of linear actuators is configured to: (i) translate the object along an axis parallel with a longitudinal axis of the drill string, (ii) translate the object along an axis transverse to the longitudinal axis of the drill string, and (iii) rotate the object.

8. The apparatus of claim 1, wherein the at least one selected movement includes at least one of: (i) linear movement along two axes at a selected angle, and (ii) movement along a curve.

9. The apparatus of claim 1, wherein the power section of the second linear actuator is connected to the body by a fifth pivot joint.

10. The apparatus of claim 1, wherein the extension section of the third linear actuator is connected to the power section of the first linear actuator by the fourth pivot joint and a sixth pivot joint, wherein the fourth pivot joint is connected to the power section of the first linear actuator, and the sixth pivot joint is connected to the extension section of the third linear actuator.

11. The apparatus of claim 1, wherein the power section of the first linear actuator is connected to the body by the third pivot joint at an anchor point in an anchor block.

12. The apparatus of claim 1, wherein the borehole comprising a longitudinal axis and the third linear actuator is configured to change an attack angle of the first linear actuator with respect to the longitudinal axis of the borehole.

13. A method for manipulating an object in a borehole in an earthen formation, comprising:

disposing a plurality of linear actuators in a body, wherein the plurality of linear actuators includes at least a first linear actuator including an extension section and a power section, a second linear actuator including an extension section and a power section, and a third linear actuator including an extension section and a power section, and wherein the extension section of the first linear actuator is connected to the object by a first pivot joint, the extension section of the second linear actuator is connected to the object by a second pivot joint, the power section of the first linear actuator is connected to the body by a third pivot joint, and the extension section of the third linear actuator is connected to the power section of the first linear actuator by a fourth pivot joint;

conveying the body into the borehole; and applying a translational and rotational movement to the object using the plurality of linear actuators.

14. The method of claim 13, wherein the power section of the third linear actuator is operatively connected to the body.

15. The method of claim 13, wherein the object comprises one of: (i) a coring container, and (ii) a fluid sampling container.

16. The method of claim 13, further comprising manipulating the object using a driveshaft, wherein the driveshaft is selected from one of: (i) a flexible driveshaft, (ii) a rigid driveshaft, and (iii) a cardan shaft.

17. The method of claim 13, further comprising measuring data with at least one sensor associated with at least one of: (i) at least one linear actuator of the plurality of linear actuators, and (ii) the object, the at least one sensor measuring at least one of: (i) a movement of the at least one linear actuator of the plurality of linear actuators, and (ii) data relating to a condition of the object.

18. The method of claim 13, further comprising manipulating the object using a drill string on which the plurality of linear actuators are positioned, wherein the plurality of linear actuators are configured to: (i) translate the object along an axis parallel with a longitudinal axis of the drill string, (ii) translate the object along an axis transverse to the longitudinal axis of the drill string, and (iii) rotate the object, and further comprising:

extending the object laterally from the drill string, wherein the object comprises a coring bit; and contacting an adjacent borehole wall with the coring bit.

19. An apparatus for manipulating an object in a borehole in an earthen formation, comprising:

a body configured to be conveyed along the borehole;

a plurality of linear actuators disposed in the body, wherein the plurality of linear actuators includes at least a first linear actuator having an extension section configured to be extended and retracted by a power section, a second linear actuator having an extension section configured to be extended and retracted by a power section, and a third linear actuator having an extension section configured to be extended and retracted by a power section, wherein the extension sections of the first linear actuator and the second linear actuator are connected to the object with a first pivot joint and a second pivot joint, respectively, wherein the power sections of the first linear actuator and the second linear actuator are connected to the body with a third pivot joint and a fourth pivot joint, respectively, wherein the extension section of the third linear actuator is connected to the power section of the first linear actuator with a fifth pivot joint.

20. An apparatus for manipulating an object in a borehole in an earthen formation, comprising:

a body configured to be conveyed along the borehole, the borehole comprising a longitudinal axis;

a plurality of linear actuators disposed in the body, wherein the plurality of linear actuators includes at least a first linear actuator, a second linear actuator, and a third linear actuator, wherein the first linear actuator and the second linear actuator are connected to the object with a first pivot joint and a second pivot joint, respectively, wherein the first linear actuator and the second linear actuator are connected to the body with a third pivot joint and a fourth pivot joint, respectively, and wherein the third linear actuator is configured to change an attack angle of the first linear actuator with respect to the longitudinal axis of the borehole.

21. The apparatus of claim 20, wherein the first linear actuator includes an extension section and a power section, and wherein the third pivot joint connects the power section of the first linear actuator to the body.

22. The apparatus of claim 20, wherein the third linear actuator includes an extension section and a power section and wherein the extension section of the third linear actuator is connected to the first linear actuator by a fifth pivot joint.

* * * * *